US006481064B2

(12) United States Patent
Kawahara

(10) Patent No.: US 6,481,064 B2
(45) Date of Patent: Nov. 19, 2002

(54) PLASTIC FASTENERS

(75) Inventor: Masahiko Kawahara, Osaka (JP)

(73) Assignee: Morito Co., Ltd., Osaka (JP)

( * ) Notice: Subject to any disclaimer, the term of this patent is extended or adjusted under 35 U.S.C. 154(b) by 0 days.

(21) Appl. No.: 09/863,416

(22) Filed: May 24, 2001

(65) Prior Publication Data

US 2002/0007534 A1 Jan. 24, 2002

(30) Foreign Application Priority Data

Jun. 26, 2000 (JP) ..... 2000-190424

(51) Int. Cl.[7] ..... A44B 17/00

(52) U.S. Cl. ..... 24/108; 24/693; 24/697.1; 24/662

(58) Field of Search ..... 24/406, 114.4, 24/104, 106–108, 585.1–586.11, 662, 630, 697.1, 693, 114.6, DIG. 16, DIG. 40, DIG. 50

(56) References Cited

U.S. PATENT DOCUMENTS 1,219,179 A * 3/1917 Smith
1,746,565 A * 2/1930 Sundback
2,000,466 A * 5/1935 Howard
3,130,464 A * 4/1964 Barlow
4,559,675 A * 12/1985 Devenny
5,357,659 A * 10/1994 Ackermann
6,182,338 B1 * 2/2001 Watanabe
6,243,927 B1 * 6/2001 Matsushima et al.

FOREIGN PATENT DOCUMENTS

FR 2079737 * 11/1971

* cited by examiner

*Primary Examiner*—James R. Brittain
(74) *Attorney, Agent, or Firm*—Bacon & Thomas, PLLC

(57) ABSTRACT

A fastener which consists of two tapes (1,2) each having a plurality of female fastener members (3,3A) attached thereto and a plurality of male fastener members (4,4A) attached thereto. Each of the female fastener members (3,3A) is provided on its attaching face with right and left bar-shaped members (31*a*,32*a*). Each of the male fastener members (4,4A) has on its attaching face a bar-shaped member which fits the female fastener member between the right and left bar-shaped members thereof (31,32).

4 Claims, 5 Drawing Sheets

PLASTIC FASTENERS

BACKGROUND OF THE INVENTION

As a linear-type fastener, there have been widely known slide fasteners called commonly zippers. They have interlocking metal toothed pieces being attached individually to two cloth tapes, by which opening and shutting of articles may be effected.

Such conventional type of slide fasteners has undergone improvements for a long period of time since the end of the $19^{th}$ century, when it was first invented and now becomes a very comfortable fastening device. However, in some instances, slide fasteners are not suited for some particular purposes.

For example, since the improvements in the past have been concentrated on achieving closely sealed interlocking of two cloth tapes, currently available slide fasteners show so great fastening strength that they resist unfastening or detachment by stretching with all one's might by both hands. However, too tightly interlocked cloth tapes may cause inconvenience depending upon their intended use, where unfastening or detachment by mere stretching with hands would be preferred. For example, in cases where unusual force is put to a fastener when, for example, clothes are rolled up by a machine in operation, a worker wearing such clothes would run a risk of losing life, unless it is broken up instantaneously.

Besides, such conventional slide fasteners cannot work unless a fastening and unfastening tool called slider is used in conjunction. It would be desirable to attain fastening and unfastening without such tools.

As mentioned above, such conventional slide fasteners have their teeth interlocked closely. When used in clothes, for example, they prevent air from flowing in and out of clothes and tend to fill the inside with heat. Consequently, they are not considered suitable for summer clothing.

SUMMARY OF THE INVENTION

The object of the present invention is to provide novel, improved fasteners which eliminate the above-described disadvantages of the conventional slide fasteners.

A fastener according to the present invention consists of two tapes each having a plurality of female fastener members attached thereto and a plurality of male fastener members attached thereto, characterized in that each of the said female fastener members is provided on its attaching face with right and left bar-shaped members and that each of the said male fastener members has on its fastening face a single bar-shaped member which fits the female fastener member between the said right and left bar-shaped members thereof.

The fastener according to the present invention exhibits such a level of fastening strength that is broken up by stretching with hands, and is considered useful in fields of application where rather weak fastening strength is preferred.

The fastener according to the present invention can be fastened and unfastened only with hands without using special fastening and unfastening tools. However, the present invention is not intended to exclude the use of such fastening and unfastening tools.

Preferably, the female and mail members are provided, respectively, on one fastening part with a concave portion and on the other with a convex portion so that the resulting fastening strength may be enhanced by advantageous engagement of such convex and concave portions.

In the fastening condition, the male fastener member is positioned between two right and left bar-shaped members of the female. According to this construction, individual fastening members are fixed at a regular interval, and when used in clothes, consequently, can facilitate air to be flown in and out of such clothes. Accordingly, the fasteners are suitable for summer clothing.

In another arrangement of the present invention, a cross-linking member may be mounted between right and left bar-shaped members on the attaching faces of the female fastener member. This arrangement allows the male fastener member to be positioned between the cross-linking members of the adjacent female fastener members. In this construction, the fastener does not unfasten unintentionally through vertical force applied in the longitudinal direction.

The non-fastening faces of the cloth tapes may assume any arbitrary form, but when taking into account the easiness of molding, the male fastener member is preferably formed into a bar-shaped member, whereas the female fastener member is in the form of "O".

BRIEF DESCRIPTION OF THE DRAWINGS

Examples of the present invention will now be described with reference to the accompanying drawings in which:

FIGS. 1(*a*) and (*b*) individually show a top plan view each of a female fastener member 3 and a male fastener member 4 being attached individually to the cloth tape, when the fastening surface is seen from above. FIG. 1(*c*) is a hypothetical illustration of the fastening condition.

FIGS. 5(*a*) and (*b*) show a female fastener member 3 and male fastener member being attached individually to the cloth tape, when the fastening face is seen from above. FIG. 5(*c*) is a hypothetical illustration of the fastening condition.

DETAILED DESCRIPTION OF THE PREFERRED EMBODIMENTS

Figure 1:
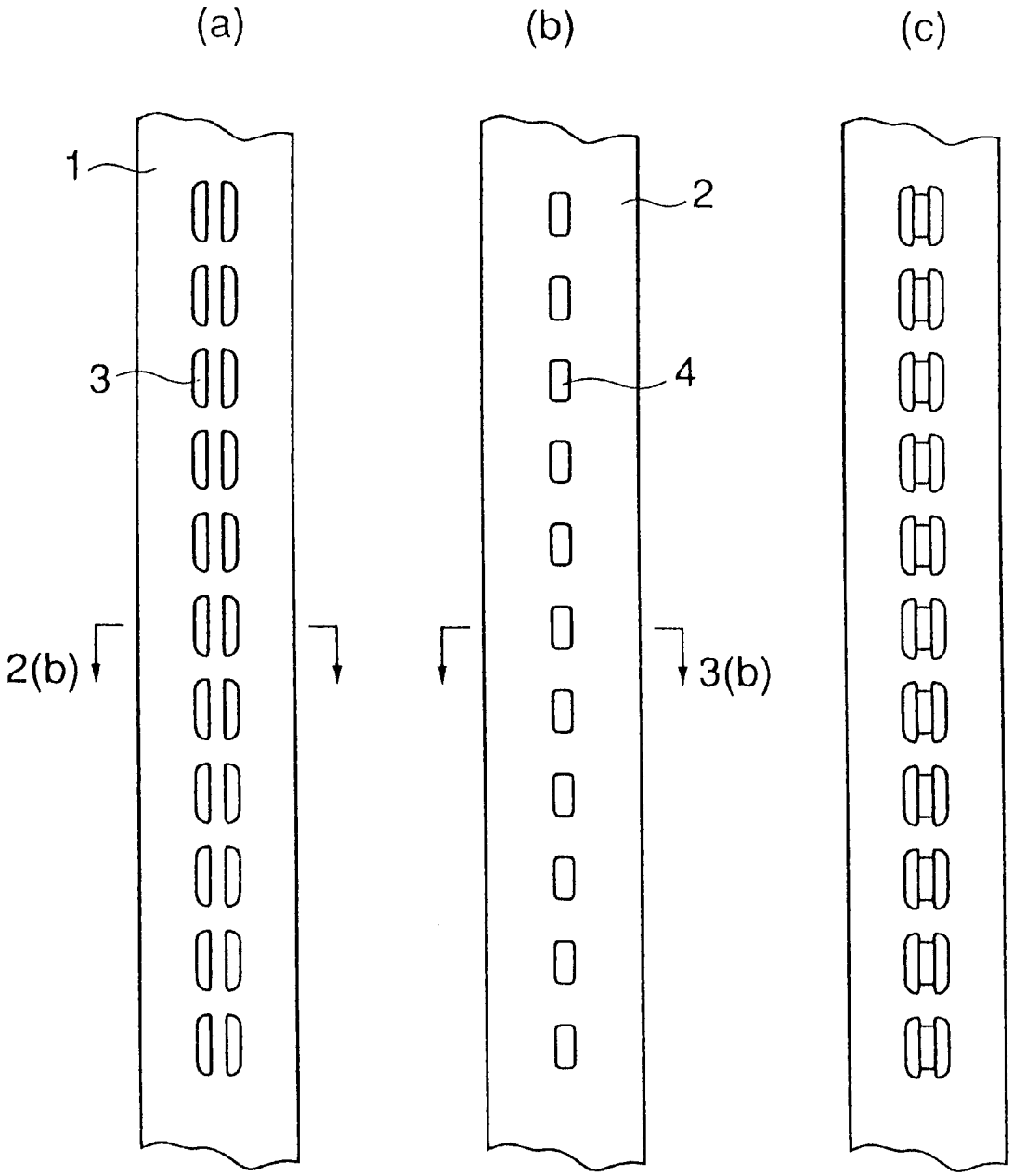
FIG. 1 is a top plan view of the fastener of Example 1 of the present invention.

FIG. 1 shows a top plan view of a fastener according to Example 1 of the present invention. FIG. 1(*a*) is a female fastener member 3 attached to a cloth tape 1 and FIG. 1(*b*) is a male fastener member 4 attached to a cloth tape 2, when the fastening faces are seen from above. The female and male fastener members 3,4 are attached individually to cloth tapes through the injection molding. The cloth tapes need to be such that they allow the permeation of molten resin without being melted themselves. Either a woven or knitted cloth, such as a cotton or blended yarn cloth can be used. For the synthetic resin, thermoplastic resin, for example, polyacetal molten resin can be used.

In a certain embodiment, the female fastener member is 6 mm long, while the male fastener member is 5 mm long, with the distance between any set of the fastener members being at 4 mm.

Figure 2:
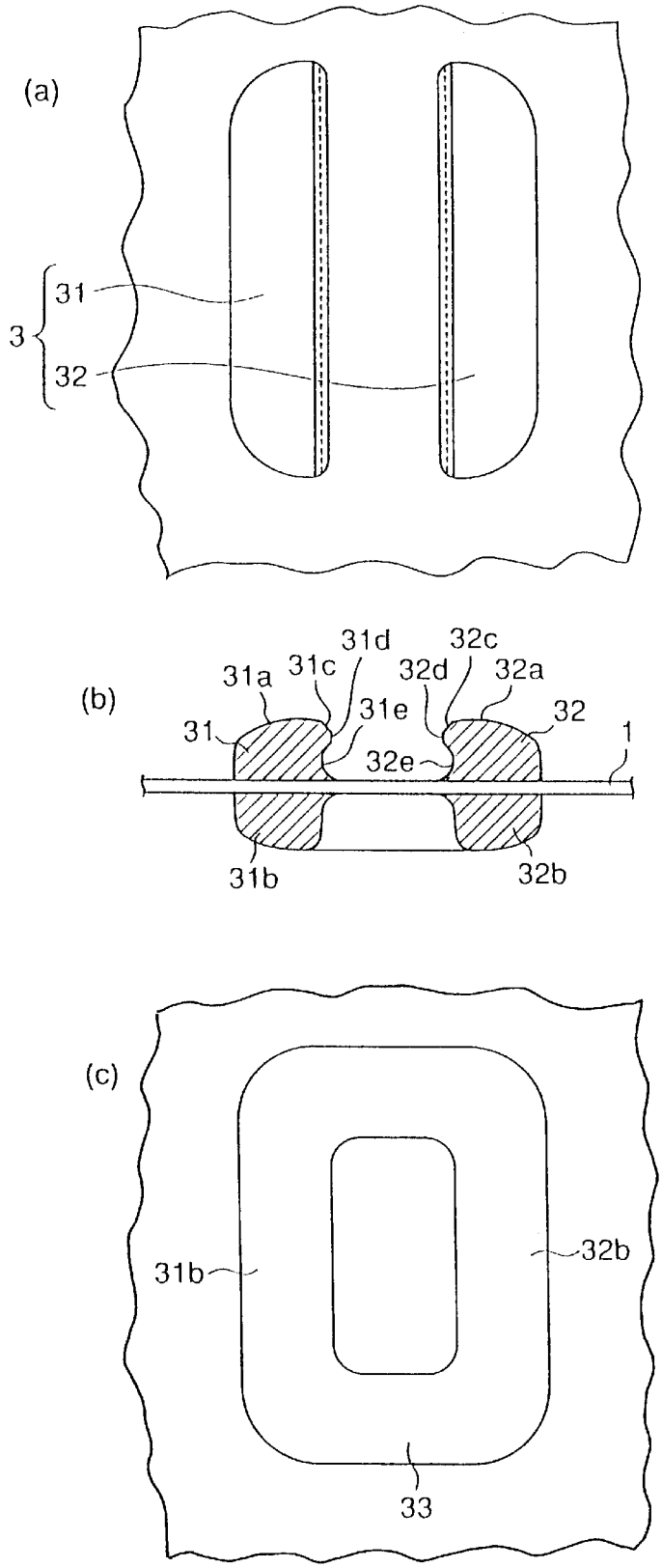
FIG. 2 is an enlarged view of a female fastener member, wherein FIGS. 2(*a*), (*b*) and (*c*) are a top plan view, sectional view and bottom view thereof, respectively.

FIG. 2 is an enlarged view of a female fastener member. FIG. 2(*a*) and (*b*) are an enlarged top plan view and bottom view thereof, respectively. The female fastener member 3 consists of right and left members which form two spaced bars being arranged to collectively define a concave portion. The right and left members thrust outwardly from both sides of the cloth tape 1 and consist of surface members 31*a,* 32*a* and reverse members 31*b,* 32*b,* with the said surface and reverse members each being communicated with the other through minute openings in texture of the cloth tape. The reverse members 31*b* and 32*b* are connected via the top and bottom ends 33, and look like the letter "O" as seen from the reverse side as shown in FIG. 2(*c*).

The right and left members are symmetric. The surface members 31*a* and 32*a* oppose individually the slanted portions 31*c* and 32*c,* top portions 31*d* and 32*d,* and recess portions 31*e* and 32*e.*

Figure 3:
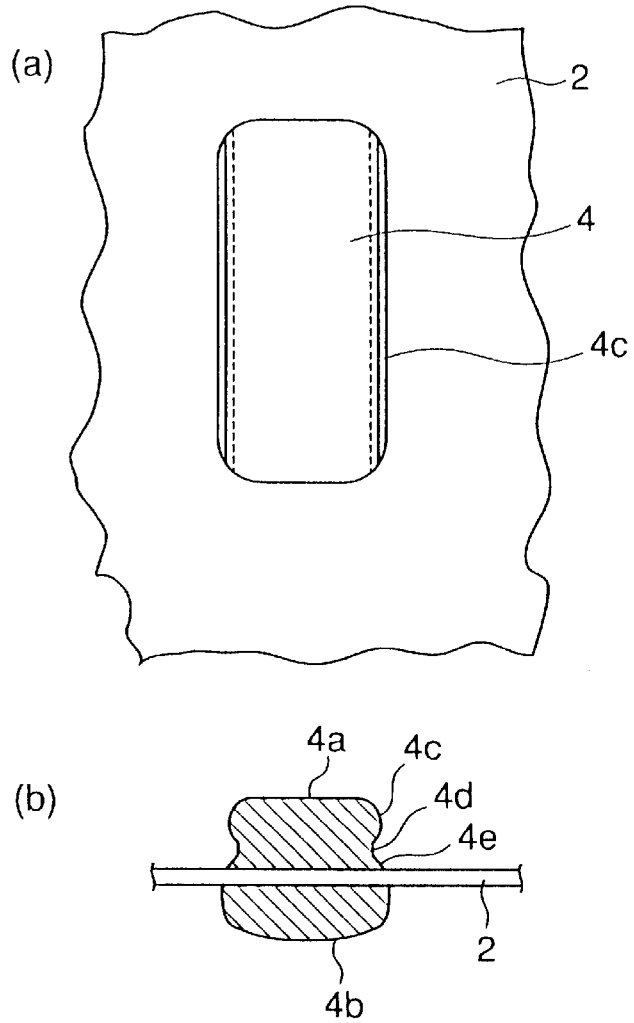
FIG. 3 is an enlarged view of a male fastener member 4, wherein FIGS. 3(*a*) and (*b*) are a top plan view and side view thereof, respectively.

FIG. 3 is an enlarged view of a male fastener member 4, wherein FIGS. 3(*a*) and (*b*) are a top plan view and side view thereof, respectively. The male fastener member 4 looks like a bar and has a surface member 4*a* defining a convex portion and a reverse member 4*b* thrusting outwardly from the cloth tape 2. The surface and reverse members each communicate with the other through minute openings in texture of the cloth tape. The surface member 4*a* has a section consisting of an upper larger-diameter portion 4*c* and a lower larger-diameter portion 4*e,* together with a smaller-diameter portion 4*d* therebetween.

Figure 4:
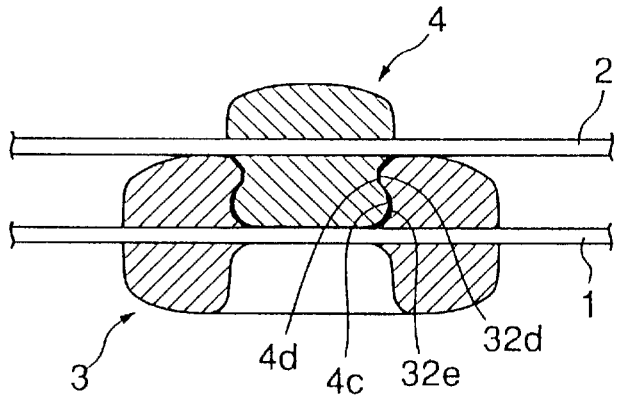
FIG. 4 is a sectional view of the fastening condition of a female fastener member 3 and a male fastener member 4.

The female fastener member 3 and the male fastener member 4 are fastened as is shown in FIG. 4. Namely, the male fastener member 4 fits the female fastener member between two right and left bar-shaped members 31, 32, wherein the upper larger-diameter portion 4*c* of the male fastener member 4 fits the recess portion 32*e* of the female fastener member 3. A top plan view of the fastening condition, which is not visible as being hidden by one of the cloth tapes, may be hypothetically illustrated as shown in FIG. 1(*c*).

To achieve fitting of both members, it suffices to press them with fingers, although some tools, such as a slider, can be used. Such fitting is effected by engaging the concave and convex portions made of plastic, and is broken up easily by stretching the two cloth tapes strongly with hands.

Figure 5:
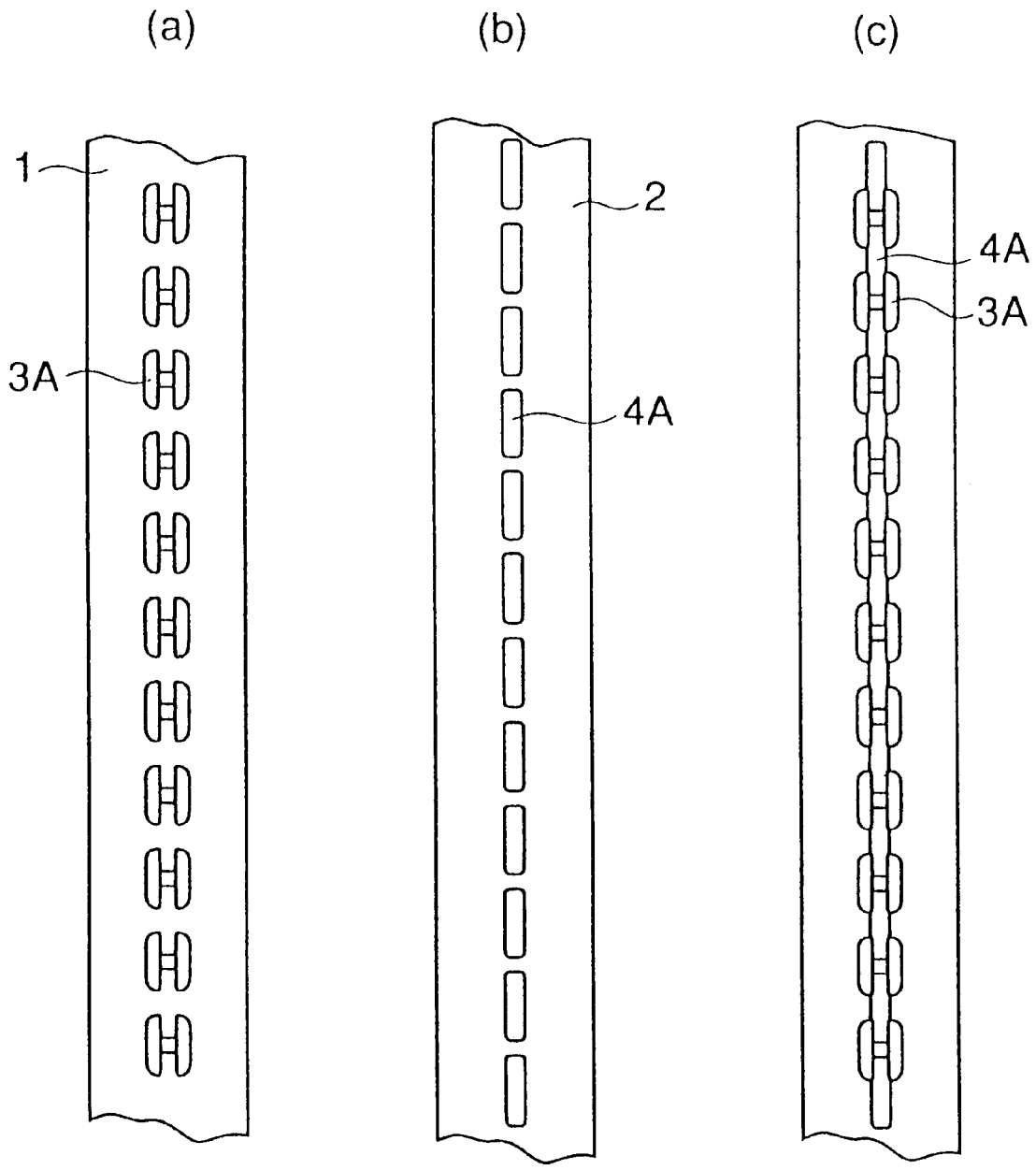
FIG. 5 is a top plan view of a fastener of Example 2 of the present invention.
Figure 6:
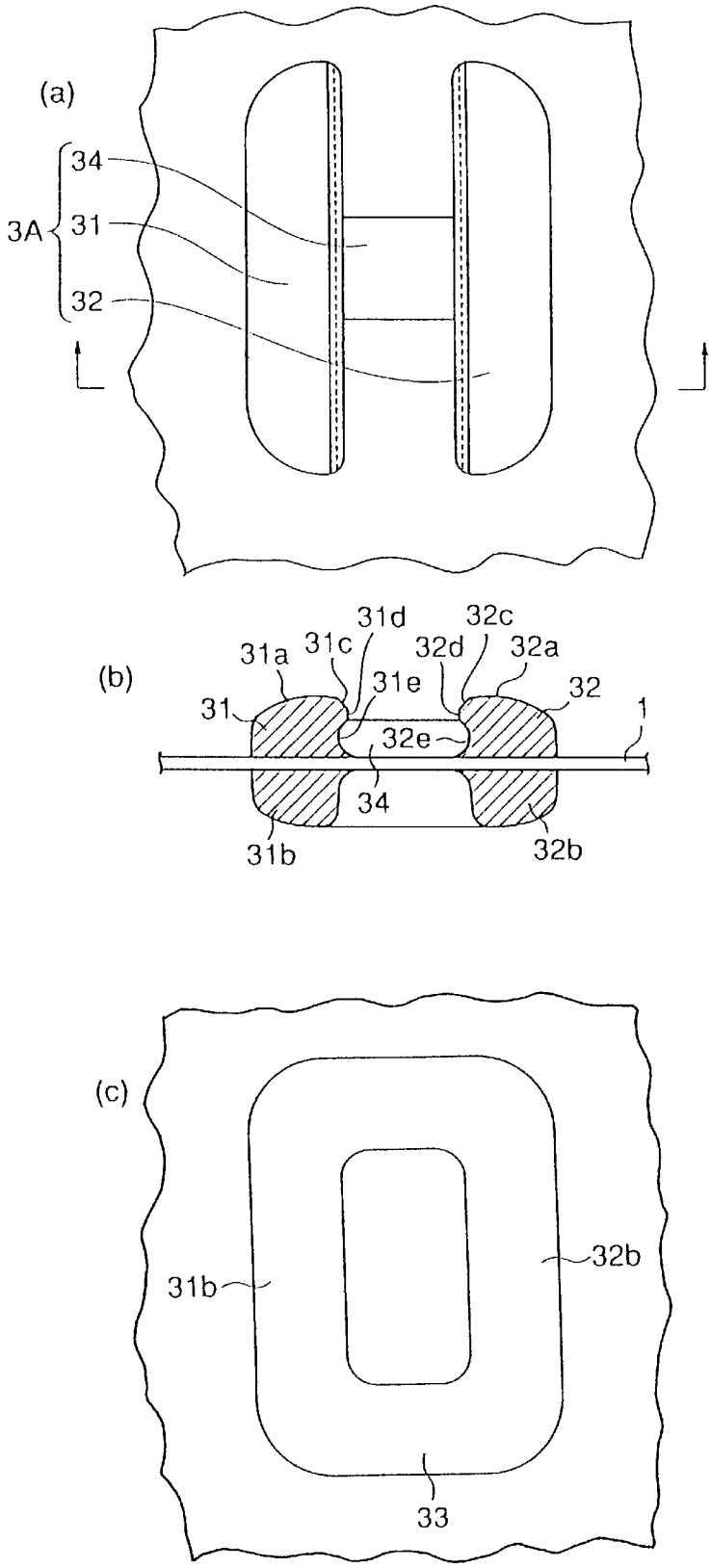
FIG. 6 is an enlarged view of a female fastener member, wherein FIGS. 6(*a*), (*b*) and (*c*) are a top plan view, sectional view and bottom view thereof, respectively.

FIGS. 5 and 6 constitute Example 2 of the present invention. FIGS. 5(*a*) and (*b*) are a top plan view each of the female and male fastener members 3A and 4A being individually attached to the cloth tapes 1, 2, when the fastening faces are seen from above. The female and male fastener members 3A, 4A are attached to the cloth tapes through the injection molding. The cloth tapes need to be such that they allow the permeation of molten resin without being melted themselves. Either a woven or knitted cloth, such as a cotton or blended yarn cloth can be used. For the synthetic resin, thermoplastic resin, for example, polyacetal molten resin can be used.

In one embodiment, the female fastener member 3 is 6 mm long, while the male fastener member 4 is 8 mm long, with the distance between any set of the female members being fixed at 4 mm.

FIG. 6 shows an enlarged view of a female fastener member 3A, wherein FIGS. 6(*a*), (*b*) and (*c*) are a top plan view, sectional view and bottom view thereof, respectively. Since most of the arrangements in Example 2 are the same as in Example 1, the same reference numbers are employed, and the description thereof is omitted. The difference between Examples 1 and 2 is that a cross-linking member 34 is mounted between the two right and left bar-shaped members 31, 32. The cross-linking member is slightly lower than the right and left bar-shaped members, as is shown in FIG. 6(*b*).

The male fastener member 4A used in Example 2 is fundamentally equivalent to the counterpart 4 used in Example 1, and the illustration and description thereof are to be omitted. Generally, however, the male fastener member in Example 2 is designed to be longer than that of Example 1.

In Example 2, the cross-linking member 34 is mounted between the right and left bar-shaped members 31, 32, which prevents the male fastening member 4A from entering between them in contrast with Example 1. Instead, as is shown in FIGS. 5(*a*) and 5(*b*), the male fastening member 4A is positioned between two cross-linking members of the adjacent female fastener members. A top plan view of the fastening condition, which is hidden by one of the cloth tapes and is invisible, may be hypothetically illustrated as shown in FIG. 5(*c*).

What is claimed is:

1. A fastener comprising:

(a) a first tape having a plurality of female fastener members attached thereto, each female fastener member being injection molded through the tape to form an attachment face on a first side of the tape and a non-attachment face on a second opposite side of the tape, each attachment face including a pair of separate spaced bar-shaped members, and each non-attachment face including a pair of spaced bar-shaped members connected together;

(b) a second tape having a plurality of male fastener members attached thereto, each male fastener member being injected molded though the tape to form an attachment face on a first side of the tape and a non-attachment face on a second opposite side of the tape, and each attachment face including a bar-shaped member; and (c) the attachment faces of the female and male fastener members being detachably engageable together for opening and closing the fastener.

2. The fastener of claim 1, wherein the attachment face of each female fastener member defines a concave portion, and the attachment face of each male fastener member defines a convex portion.

3. The fastener of claim 1, wherein the attachment face of each female fastener member includes a cross-linking member disposed between the pair of separate spaced bar-shaped members and the bar-shaped member of each male fastener member is engageable between the cross-linking members of the attachment faces of two adjacent female fastener members.

4. The fastener of claim 1, wherein the non-attachment face of each male fastener member includes a bar-shaped member and the non-attachment face of each female fastener member is of an O-shaped configuration.

* * * * *